US005508980A

United States Patent [19]

Koch

[11] Patent Number: 5,508,980

[45] Date of Patent: Apr. 16, 1996

[54] ANALOGUE DISPLAY TIMEPIECE COMPRISING MEANS FOR PROCESSING A DECIMAL NUMBER

[75] Inventor: Daniel Koch, Crémines, Switzerland

[73] Assignee: Eta SA Fabriques d'Ebauches, Grenchen, Switzerland

[21] Appl. No.: 368,323

[22] Filed: Jan. 4, 1995

[30] Foreign Application Priority Data

Jan. 7, 1994 [CH] Switzerland ..... 00 048/94

[51] Int. Cl.[6] ..... G04B 19/04

[52] U.S. Cl. ..... 368/80; 368/223; 368/228

[58] Field of Search ..... 368/223–239, 368/80

[56] References Cited

U.S. PATENT DOCUMENTS 4,266,288 5/1981 Berney ..... 368/28
5,077,708 12/1991 Schneider ..... 368/107
5,222,053 6/1993 Ohhira ..... 368/73
5,379,281 1/1995 Koch ..... 368/72

FOREIGN PATENT DOCUMENTS 2371826 6/1978 France .
2404250 4/1979 France .
2905472 8/1979 Germany .

*Primary Examiner*—Bernard Roskoski
*Attorney, Agent, or Firm*—Weil, Gotshal & Manges

[57] ABSTRACT

The invention concerns an analogue display timepiece.

This timepiece comprises means for processing at least one decimal number having several figures corresponding to a period of time required to elapse before the activation of an alarm, and it is characterized in that it comprises a first display system (S1) cooperating with a first hand (H) to indicate selectively the order or significance of said figures, and a second display system (S2) cooperating with a second hand (MN) to indicate the value of the figure whose order or significance is indicated by the first hand (H).

12 Claims, 4 Drawing Sheets

TIME-KEEPING MODE

PRESSURE
TIME ADJUSTMENT

PULLED OUT STEM
PROCESSING MODE

SUPERPOSED ADJUSTMENT POSITION 3
2 SEC.
HUNDREDS

ADJUSTING THE HUNDREDS 6
2 SEC.
TENS

ADJUSTING THE TENS 5
2 SEC.
UNITS

ADJUSTING THE UNITS

2 SEC.
PUSHED IN STEM
ALARM MODE

PRESSURE

ANALOGUE DISPLAY TIMEPIECE COMPRISING MEANS FOR PROCESSING A DECIMAL NUMBER

The present invention concerns an analogue display timepiece comprising means for processing one or more decimal numbers.

More particularly, the invention relates to a timepiece able to display, essentially with the aid of hands, notably the minute and hour hands, decimal numbers corresponding to a programmed period of time required to elapse before the activation of an alarm.

The term "alarm" is to be understood widely here as the provision of a particular message to the user, whether in a visual form, the form of a sound or otherwise, to inform the user of the elapse of a programmed period of time.

In a particular application, the decimal number programmed into this timepiece may represent a number of days until the arrival of a date, for example a meeting or a birthday.

A purpose of the present invention is thus to provide an analogue timepiece which is of simple design and simple to operate, reliable and inexpensive, capable of processing that is to say, of displaying, storing and dealing with one or more decimal numbers corresponding to a programmed alarm time.

Another purpose of the invention is to provide a timepiece capable of displaying and processing decimal numbers in a clear, easily readable and intelligible way so as to guarantee to the user that this timepiece will be easy to operate without risk of error.

The invention thus concerns an analogue display timepiece comprising means for processing at least one decimal number having a plurality of figures corresponding to a period of time required to elapse before the activation of an alarm, characterised in that it includes a first display system cooperating with a first hand to indicate selectively the order or the significance of said figures, and a second display system cooperating with a second hand to indicate the value of the figure whose order or significance is indicated by the first hand.

According to a particular embodiment, the first display system is arranged in a first angular sector defined on said timepiece, while the second display system is arranged in a second angular sector, complementary to the first.

It is also to be noted that the first display system comprises decimal multiples which define the order or significance of said figures and which are marked between the 9 o'clock and 12 o'clock positions of said timepiece, the second display system comprising indications 0 to 9 which are in the same place as the 9 o'clock to 12 o'clock indications of a conventional time display.

According to another particular characteristic of the invention, the first display system comprises the indications 1, 10 and 100.

Other characteristics and advantages of the invention will appear more clearly upon reading the following detailed description, made with reference to the attached drawings which are given here purely by way of example, and in which.

Figure 1:
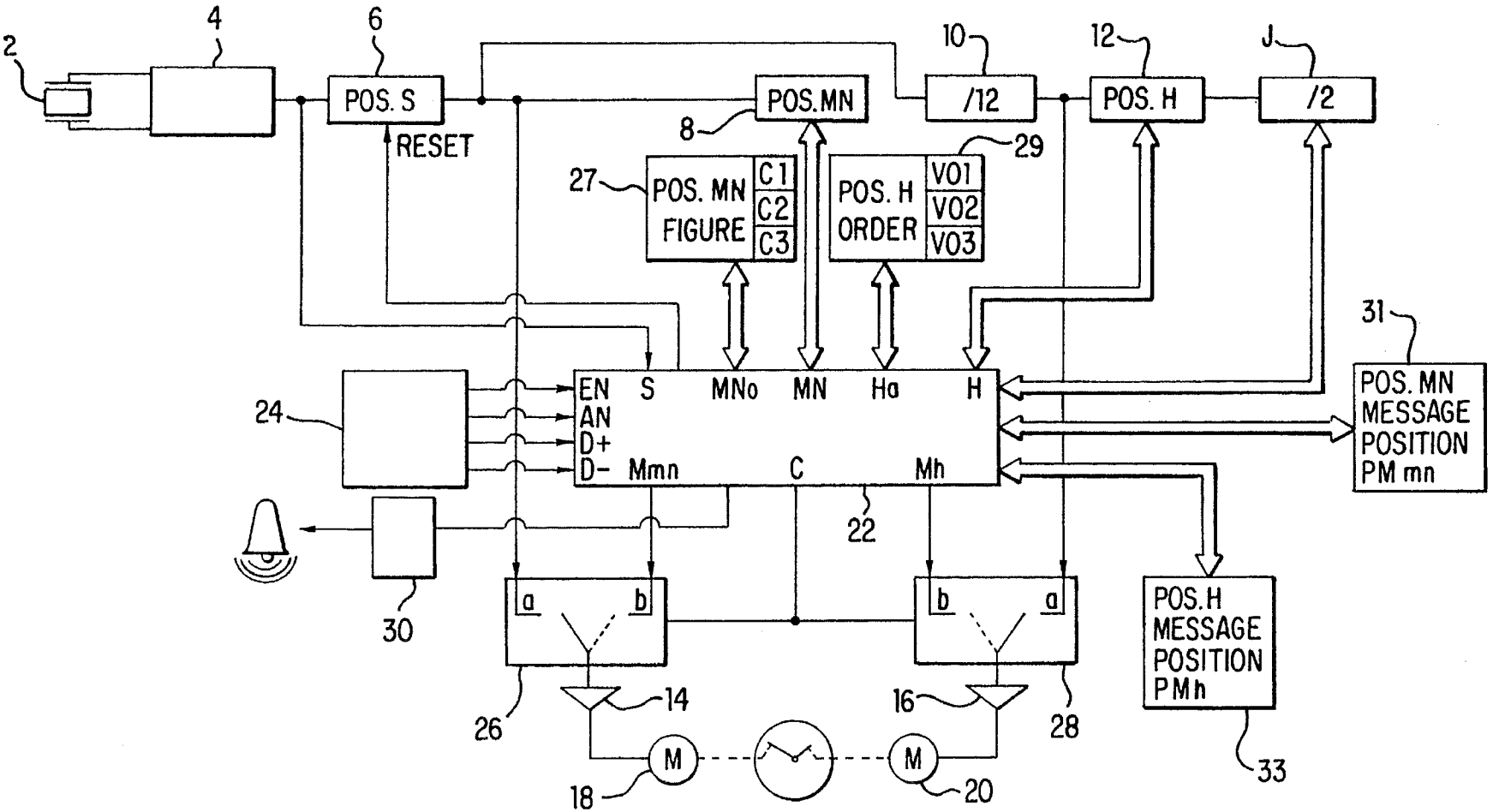
FIG. 1 shows in the form of a block diagram a watch according to an embodiment of the present invention.
Figure 4A:
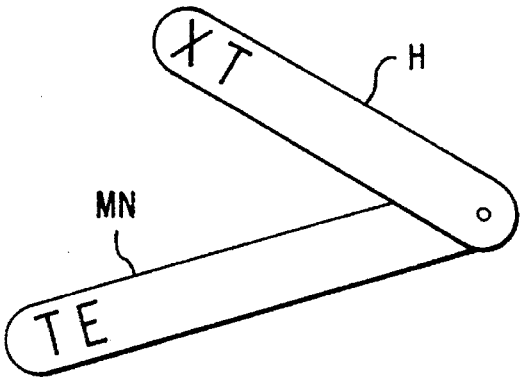
Figure 4B:
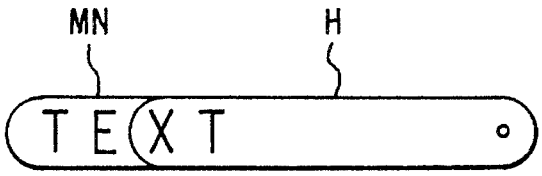
Figure 3:
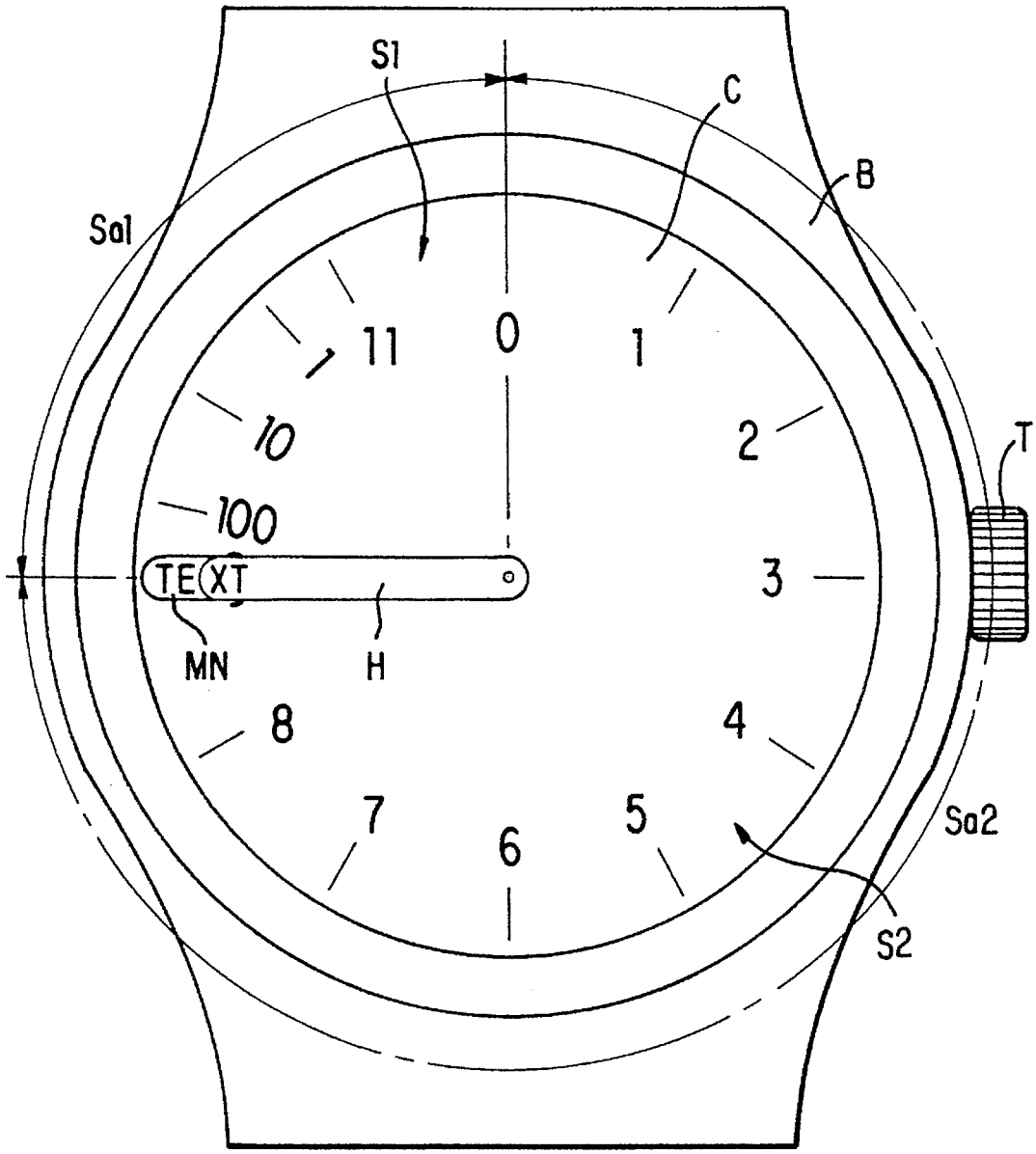
FIG. 3 is a top view of a timepiece according to a particular embodiment of the invention.
Figures 5A, 5B, 5C, 5D, 5E, 5F, 5G, 5H, 5I, 5J, 5K:
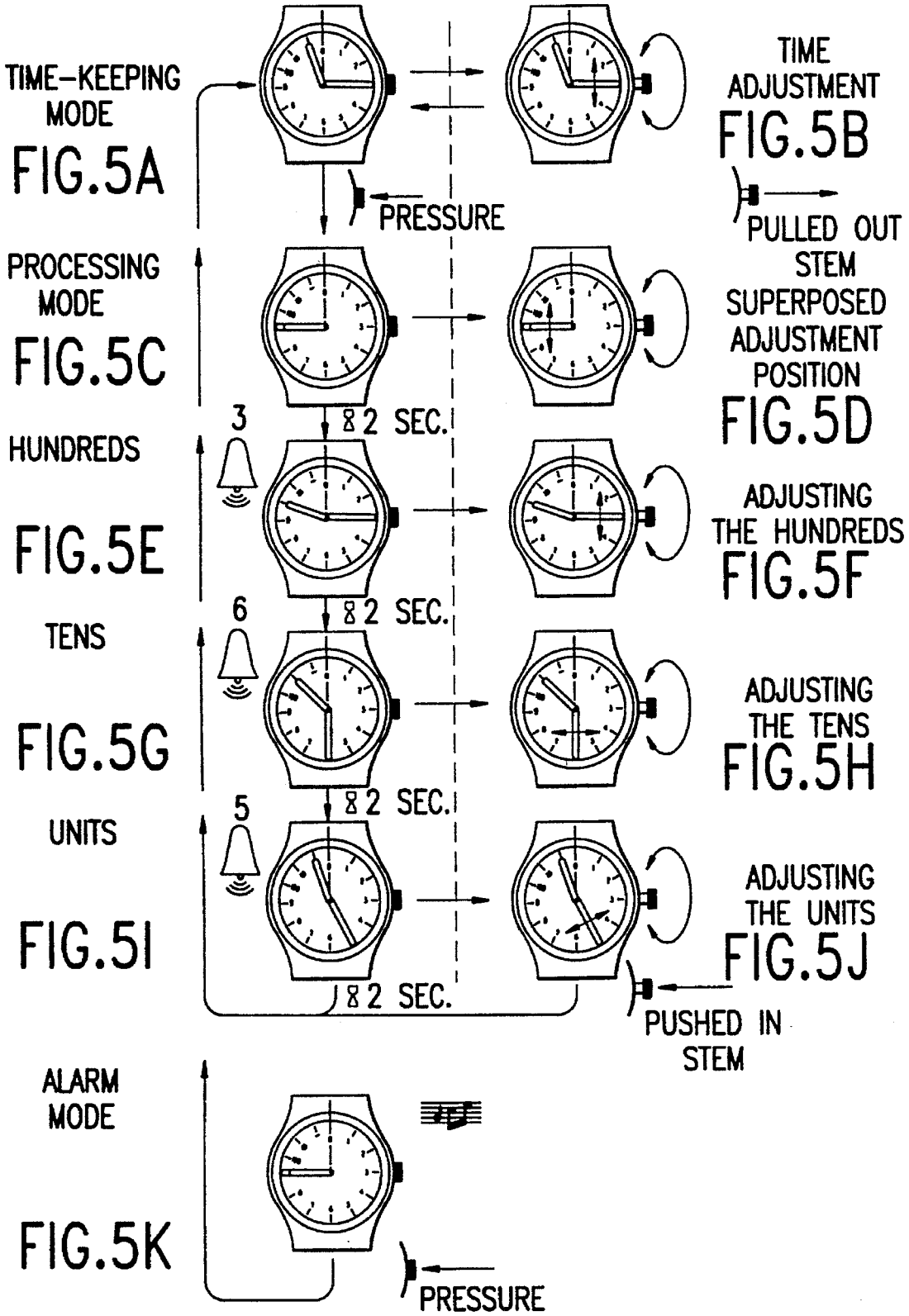

FIG. 4 is a top view showing in a more detailed way the hour and minute hands of the timepiece of FIG. 3, in two characteristic positions, respectively (A) time display and (B) alarm message display; and FIG. 5 is a table or flow chart of the different display functions fulfilled by a timepiece according to a simplified embodiment of the present invention, this timepiece incorporating the block diagram of FIG. 1.

FIG. 1 thus shows, in the form of a block diagram, a timepiece, for example a watch, constituting an embodiment of the present invention.

This timepiece, as will be understood below, is adapted to be able to process, that is to say at least to be able to display in an essentially analogue way, with the aid of its hands, a compound decimal number corresponding to a programmed period of time required to elapse before the activation of an alarm.

The term "process" is used widely here and also covers storage, control, calculation and generally all the combinations and operations carried out on decimal numbers.

In the embodiment example which will be described below, the decimal number processed represents a number of days which are counted down until the advent of a date, for example a meeting or a birthday.

In this embodiment example, this processed decimal number is programmed by the user, but it is clear that this invention may also be applied to a timepiece supplied with a decimal number already preprogrammed by a supplier, which it is not possible to change, for the purpose, for example, of providing an alarm at the advent of an important date, in particular a new century, a national holiday, or suchlike.

Further, it will be seen that, in the embodiment example described, the user is provided, at the advent of said date, with alarm data in the form of an alphanumerical message, whose composition is made intelligible by hands, in particular hour and minute hands which will be described below. Although this embodiment is particularly advantageous, the invention is not limited to this type of alarm, which may be a sound alarm or formed of any other means.

As is seen in FIG. 1, the timepiece according to the invention comprises, in series, a quartz oscillator 2, a division chain 4 supplying a signal at 1Hz, a second hand position counter referenced 6, and a minute hand position counter, referenced 8.

It also comprises a divider-by-twelve referenced 10, receiving the signal from second hand position counter 6, and an hour hand position counter, referenced 12 whose input is connected to the output of divider 10. Counters 6, 8 and 12 are counters-by-sixty whose operating mode is schematically represented by FIG. 2.

Figure 2:
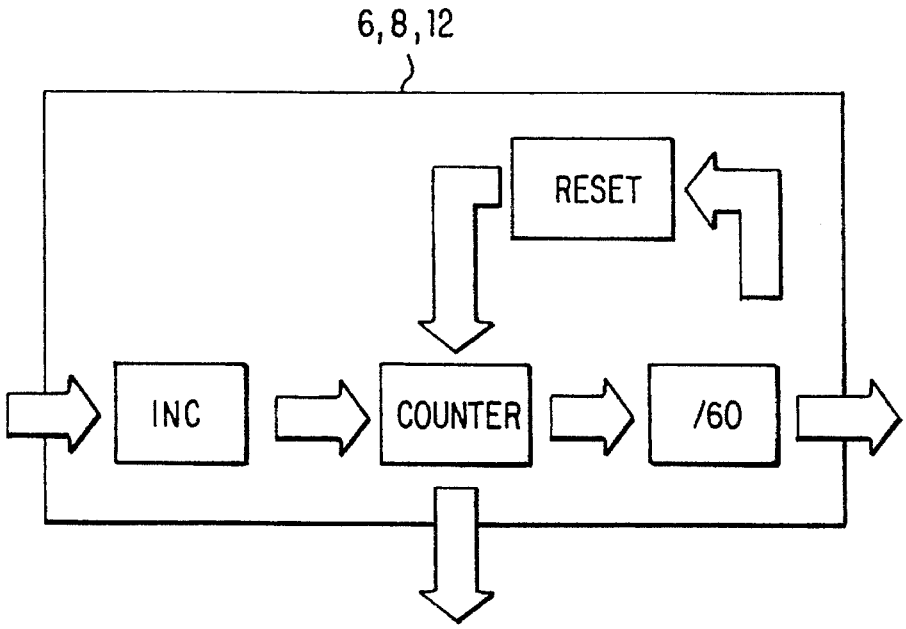
FIG. 2 is a diagram showing the operation of a position counter, of the type of those incorporated in the diagram of FIG. 1.

As is seen in FIG. 2, the pulses to be counted are provided to the counters (arrow to the far left of the drawing). These successive pulses are counted by a binary register of at least six bits, which they increment. The state of this register can be read at any time (arrow towards the bottom of the drawing). At each incrementation, the register is tested to see if the number which it contains equals sixty. If this is the case, a pulse is emitted by the test circuit and this pulse causes the register to be reset to zero. The test circuit thus consists of a divider-by-sixty whose signal may be emitted to another counter (arrow on the right of the drawing), which is the case of counters 6, 8 and 12. This timepiece also comprises a day counter J which receives a signal every twelve hours from counter 12. Day counter J is a divider-by-2 which provides a signal every twenty four hours.

Counters 8 and 12 (FIG. 1) characterise, in standard operating mode, that is to say in time providing mode, the position, defined according to sixty steps, of the minute and hour hands in relation to the hour circle of the timepiece. As the timepiece described here does not include a second hand, the second hand position counter is used solely to provide a signal whose frequency enables the other counters 8 and 12 to be incremented in an appropriate manner.

This timepiece is also provided with two motors 18 and 20 able to be independently controlled respectively by driving circuits 14 and 16 to drive respectively the minute hand MN and the hour hand H (FIGS. 3 and 4).

Circuits 14 and 16 receive, in standard time mode, the pulses applied respectively to the inputs of minute hand position counter 8 and hour hand position counter 12.

The arrangement of the motors and gear trains of the present timepiece will not be described here. Clockwork movements comprising a plurality of motors to activate the hands individually are already known. Patent no. EP-O 393 606 in particular discloses a clockwork movement comprising two motors capable of driving the minute hand and hour hand independently.

The elements which have just been described explain the operation of this essentially analogue timepiece as regards the standard time display. However, in conformity with the present invention, the analogue watch described here can also process decimal numbers, and display, store and calculate them in order subsequently to activate an alarm.

The elements of FIG. 1 which will now be described enable these specific functions to be provided.

As can be seen in FIG. 1, the timepiece according to the invention comprises electronic control means 22 which enable it to fulfil various time display functions and a function called a "processing" function for one or more decimal numbers. These electronic control means 22 comprise inputs MN and H for receiving the contents of minute and hour hand position counters 8 and 12, two activation inputs AN, EN and two inputs $D^+$, $D^-$ for data concerning the displacement of the hands respectively forwards and backwards.

The signals applied to inputs AN, EN, $D^+$, $D^-$ are provided by a circuit 24 for interpreting the position and displacement of the control stem, referenced T and shown in FIG. 3. The operation of control stem T and interpreting circuit 24 will not be described in detail here as a man skilled in the art already knows devices of this type. Patent no. EP-O 175 961 in particular, discloses a control stem used with an interpreting circuit which can easily be adapted for use with the timepiece presently described.

Electronic control means 22 also comprise two outputs Mmn and Mh to supply pulses to motors 18 and 20 and a control output C to control the state of two switches 26, 28 arranged at the input of driving circuits 14, 16 and arranged to transmit to them, either the pulses applied to the inputs of minute and hour hand position counters 8 and 12 when the switches are in a first position referenced a, or the pulses supplied by electronic control means 22, when the switches are in a second position referenced b.

Electronic control means 22 may be advantageously realised in the form of an integrated circuit comprising a programmed micro-controller. A man skilled in the art will know, from the indications provided here, how to carry out the programming of the micro-controller, so as to enable it to execute the functions described.

In standard time display mode, the electronic control means are inactive and motors 18 and 20 receive the pulses applied to the inputs of minute and hour hand position counters 8 and 12.

Referring henceforth to FIG. 3, a description will now be given of an embodiment of the timepiece according to the invention, and more particularly its display systems which enable decimal numbers to be composed.

The timepiece 1 comprises in the conventional manner a case B, as well as a control stem T, of which the crown, more particularly, is seen here.

Timepiece 1 further comprises a dial C on which is arranged a conventional time display (not referenced) comprising indications 0 (at the conventional 12 o'clock position) to 11, marked clockwise on dial C.

In addition, and according to the invention, timepiece 1 comprises a first display system S1 cooperating with a first hand, here hour hand H, to indicate selectively (see FIG. 5, steps E to J), the order and significance of the figures of the number to be processed, which, in the example described with reference to FIG. 5, is the number 365.

The notion of order or significance is used here to indicate generally different classes of information, notably the values 1, 10 and 100 which represent respectively the units, the tens and the hundreds of the decimal number to be processed.

As is seen in FIG. 1, first display system S1 is arranged in a first angular sector Sa1 defined on said timepiece. Thus, this first display system S1 comprises decimal multiples 1, 10 and 100 which define the order or significance of said figures of the number or numbers to be processed and which are marked clockwise between the 9 o'clock and 12 o'clock positions (replaced here by 0) of timepiece 1.

It is noted that the indication 10 is in the same place as the conventional 10 o'clock time display indication, while the indication 1 is arranged between the 10 o'clock and 11 o'clock indications of this display.

Further, the indication 100 is placed between the conventional 9 o'clock and 10 o'clock time display indications.

Furthermore, timepiece 1 comprises a second display system S2 cooperating with a second hand, here minute hand MN (see steps E to J of FIG. 5) to indicate selectively the values 0 to 9 of the figures of the decimal number to be processed.

As is seen in FIG. 3, second display system S2 is arranged in a second angular sector Sa2, complementary to first system S1.

Thus, it will be noted that second display system S2 comprises indications 0 to 9 which are in the same place as the respectively conventional 12 o'clock (mark 0) to 9 o'clock time display indications.

Upon reading FIG. 5 (steps E to J), one thus sees that the second hand, notably minute hand MN (shown in the conventional manner as being the longer) can indicate the value (here 0 to 9) of the figure whose order or class is indicated by the first hand, inter alia, hour hand H.

In the example shown, the two display systems S1 and S2 are arranged advantageously on the dial, but in a non-limitative way, the latter also being able to be arranged on a bezel of case B or on a glass, not shown.

The table or flow chart of FIG. 5 comprises eleven drawings or steps (referenced from A to K) each showing one of the different display functions able to be fulfilled by the hands of the watch according to the invention. The arrows which connect the different steps A to K and the few accompanying indications enable an understanding of how the control stem (not referenced here) is activated to select one of the different display functions, in the different operating modes described.

Time setting

The elements which have just been described enable the time displayed by the hands to be adjusted (which corresponds to step B in the table of FIG. 5).

When the watch is in standard time display mode (illustrated by step A), the time adjusting function is activated by pulling out the stem (step B). The outward movement of the stem causes interpreting circuit 24 (FIG. 1) to emit a signal to input EN of electronic control means 22. The receipt of this signal by electronic control means 22 drives switches 26 and 28 to pass into state b. Simultaneously, electronic control means 22 emit a high signal along the reset line of the second position counter referenced 6 to keep it at zero so that it no longer sends the incrementation signal of minute and hour hand position counters 8 and 12.

Interpreting circuit 24 then sends pulses corresponding to the various rotational movements made to the stem by the user, towards inputs $D^+$, $D^-$ of electronic control means 22 which, in turn, emit control pulses to increment or decrement minute and hand position counters 8 and 12 and to control simultaneously motors 18, 20 in order to move the hands. When at the end of the time setting operation, the stem is pushed back in (step A), interpreting circuit 24 provides a deactivating signal to electronic control means 22 which in turn provide a signal via their output C to make switches 26, 28 pass into state a. Simultaneously, the signal along the reset line reverts to zero and second hand position counter 6 restarts.

Decimal number processing mode

As has been mentioned above, the timepiece described here is provided to carry out an additional function called the processing function.

To this end, it comprises two multiple registers 27 and 29 (FIG. 1) to store the numerical values which will be used to compose, by combination, a decimal number representing in this example a number of days to be counted down, here the number 365, before setting off an alarm.

Fixed values VO1, VO2 and VO3 which correspond respectively, in binary form, to the order or significance values 100, 10 and 1 marked on dial C, in first display system S1, are stored in register 29. In this case, electronic control means 22 comprise a conversion table which can convert these decimal values, recorded in binary form, respectively into values 1 to 60 corresponding to the particular positions of the hour hand on dial C so that it indicates these decimal order values.

Values C1, C2 and C3 which correspond, also in binary form, to the selected values of the figures 0 to 9 marked on dial C, in second display system S2, are stored in register 27. Electronic control means 22 also comprise another conversion table which can convert the values 0 to 9 of these figures, selected and recorded in binary form, respectively into values from 1 to 60 corresponding to the positions of the minute hand on dial C, so that they indicate the figures 0 to 9.

The timepiece according to the invention also comprises two other counters or registers 31 and 33 enabling respectively two numerical values PMmn and PMh to be stored, also ranging between 1 and 60 and corresponding respectively to a position of the two hands when they provide an alarm message, at the expiry of the programmed and number of days to be counted down.

FIGS. 3 and 4 show that hour hand H and minute hand MN carry an alphanumerical message which can only be reconstituted and made intelligible in a characteristic superposed position of hands H and MN.

As is seen more particularly in FIG. 4, minute hand MN which is the longer and which is placed under hour hand H, carries near to its free end, a first part of a message, here the first two letters T and E of the heading "TEXT", while hour hand H, which is the smaller, carries a second part of this message, the last two letters, X and T.

In their position shown in step A (FIG. 4), the two time hands H and MN display time information, in an analogue and conventional way, for example 10 hours and 42 minutes.

In their position shown in step B of FIG. 4, the two hands are brought into a superposed position by the action of independent motors 18 and 20 which are driven by electronic control means 22, which reconstitutes in this position the message "TEXT" marked on these hands, and provides it in an intelligible way to the user, It is in this form that the user is informed of the arrival of an event (step K), that is to say, in a visual way by a clear alphanumerical message.

In this superposed position which is selected at 9 o'clock, the two values PMmn and PMh of registers 31 and 33 equal 45.

In the examples shown in FIGS. 1 and 3, the timepiece according to the invention comprises in addition an acoustic signal synthesiser circuit referenced 30, which is connected to electronic control means 22. This circuit is activated at selected moments during the decimal number programming stages and/or when the alphanumerical message is provided to the user, that is to say when the alarm is set off.

The user, when he wishes to consult or change the decimal number representing the number of days to be counted down before the alarm is activated, and when he wishes to activate or deactivate the alarm function, must carry out a certain number of manipulations of the control stem, these manipulations being shown in FIG. 5, to which reference will now be made. It is to be noted that the watch of FIG. 5 has been shown in a simplified way to improve understanding of the drawings, the indication "11" having been omitted.

Entry into "processing" mode

When the watch is in standard time display mode, and interpreting circuit 24 (FIG. 1) emits, towards input AN of electronic control means 22, an activation signal corresponding to a push on the stem, electronic control means 22 emit a signal via their output C to put switches 26 and 28 into state b (FIG. 1), namely to block the pulses coming from counters 8 and 12. Simultaneously, electronic control means 22 read the contents of counters 8 and 12 in order to determine the position of the minute and hour hands. They then emit the requisite number of pulses to outputs Mmn and Mh to bring the hands to superpose each other in a selected position on the timepiece to enable the indication "TEXT" to be displayed on the dial, as shown in step C of FIG. 5 and more particularly in FIG. 3 (this does not affect the operation of counters 6, 8 and 12). This position also corresponds to the position of the hands shown at step B of FIG. 4. By way of example, if the hands are brought into their superposed alphanumerical display position at 9 o'clock on the timepiece, as is the case in FIG. 5 (step C), electronic control means 22 bring hands MN and H to superpose each other facing the 9 o'clock symbol by emitting a number of pulses equal to the number of pulses which would be necessary to make the contents of counters 8 and 12 both equal to 45, this value 45 being read from counters or registers 31 and 33.

It is to be noted here that in the case of the embodiment shown in FIG. 3, the hands may superpose each other in any position in relation to the dial, provided that the characters have been printed in a direction allowing them to be read.

The indication of entry into alarm mode by the two hands superposed at 9 o'clock on the dial is thus immediately perceptible to the user to whom a reconstituted alphanumerical message appears very clearly. In addition, it is to be noted that this overlapping configuration of the hands is unusual in this area of the dial and cannot in any circumstances be confused with an indication of the time.

Thanks to the fact that electronic control means 22 have brought the two hands into the position in which they provide the alphanumerical text message marked on them, the timepiece indicates to the user entry into the specific operating mode described here, namely processing or alarm day programming mode. At this moment (step D), the user may change the superposition position if he wishes by pulling out the stem and rotating it in a corresponding manner. Values PMmn and PMh are thereby modified.

After returning the stem from the pulled out position to the rest position (step C), electronic control means 22 remain in a standby mode until they have determined, by counting the pulses of 1 Hz emitted by division chain 4, that two seconds have elapsed. If these two seconds elapse without the control stem having been activated again, the electronic control means will display via the two display systems S1 and S2 of the watch (step E, FIG. 5) a first value (here the greater value) of order or significance, or a class of values, and said electronic means will simultaneously cause to be displayed the figure corresponding to this value. The hundreds and the FIG. 3 are thus displayed by these two display systems. In this example, the decimal number 300 which is read from registers 27 and 29 (C1=3 and V01=100, in binary form) by electronic control means 22, is displayed by hands H and MN, via a displacement by a corresponding number of steps driven by electronic control means 22, after reading the conversion tables in order to provide motors 18 and 20 with the number of pulses necessary for the displacement of the hands.

By pulling out the stem (step F), the user may modify the position of the minute hand to select a new figure in the range of figures from 0 to 9, in order to modify the hundreds figure of the number which he wishes to program.

It will be noted that the hour hand which is independently driven, remains in a fixed position during this operation and cannot be moved by the user. It thus permanently indicates during the entire duration of the programming operation the class, order or the significance which is being processed, whilst the figure (quantity) relating to it may be modified by minute hand MN, in collaboration with second display system S2.

The modification of the hundreds having been carried out, the user pushes the stem back in (step E). The pair of values 100 and 3 which is maintained here is validated as decimal number 300 (the order of the greater value thus having the FIG. 3). This pair of values is stored as such or converted, in binary form, in registers 27 and 29 as V01 and C1.

Again, after a pause of two seconds, the operation is repeated with the tens (steps G and H), then again following this operation with the units (steps I and J).

The values V01-C1, V02-C2 and V03-C3 have thus been stored, corresponding to the number of the hundreds (here the number 300), the tens (here the number 60) and the units (here the number 5) to record, in a broken down way and by analogue means, the number 365 which will be registered in electronic control means 22 or, in another embodiment, which will be stored in binary form in another register which is not shown.

Once these operations are completed, the watch reverts to time display mode, shown in step A, after electronic control means 22 have read position counters 8 and 12 and the subsequent driving action of motors 18 and 20. Switches 26 and 28 are then returned to state a.

The operations which have just been described relate to the programming of decimal numbers, used here to form another compound decimal number.

This processing mode may also enable only one decimal number or several decimal numbers to be read, preprogrammed by the user or by the watch supplier, by a combination of the hour and minute hands. After a simple pressing action on the stem and after step C, the watch according to the invention successively displays all the orders/figure pairs, as shown by steps E, G and I. During this succession of display operations, the timepiece emits at each step a corresponding number of "beeps", here respectively 3, 6 and 5.

Activation of the alarm, entry into alarm mode

When the timepiece according to the invention is in standard time display mode (step A) and the alarm has been activated, an alphanumerical message and possibly an acoustic signal are emitted when the contents of register 29 have been completely counted down by electronic control means 22, thanks to the day data received by day counter J, that is to say, as soon as values V01, V02 and V03 have been counted down to the value 0 (zero), namely in this example after 365 days have elapsed. At this moment, electronic control means 22 (FIG. 1) brings, previously as described, display hands H and MN into a superposed configuration, in their alphanumerical message display position (step K, FIG. 5; step B, FIG. 4 and FIG. 3). During this visual alarm activation period, an acoustic message may be provided, once or repeatedly, according to the selected sequences.

The hands may be held in this position until the user has interrupted the emission of the alarm signal by pressing on the stem. The pressure exerted on the stem causes interpreting circuit 24 to emit towards electronic control means 22 a signal, in order on the one hand to interrupt the acoustic signal and on the other hand to deactivate the alarm.

As soon as pressure has been exerted on the stem marking the deactivation of the alarm, the watch reverts to its time display mode (step A).

What is claimed is:

1. An analogue display timepiece comprising first and second hands, an alarm, means for processing at least one multi-digit decimal number, each of the digits of said number having a plurality of possible values, said decimal number corresponding to a period of time which must elapse before the activation of said alarm, a first display system cooperating with said first hand for selectively and serially indicating the order of said digits, and a second display system cooperating with said second hand for serially indicating the value of the digits corresponding to the orders being indicated by the first hand.

2. A timepiece according to claim 1, wherein said first display system includes a first angular sector defined on said timepiece, and said second display system includes a second angular sector, complementary to the first.

3. A timepiece according to claim 1, wherein the first display system comprises decimal multiples which define the order of said digits and which are marked between the 9 o'clock and 12 o'clock positions of said timepiece, and the second display system comprises indications 0 to 9 marked in the same place as the 12 o'clock to 9 o'clock indication of a conventional time display.

4. A timepiece according to claim 1, wherein the first display system comprises indications 1, 10 and 100.

5. A timepiece according to claim 4, wherein the indication 10 of the first display system is identical to the 10 o'clock indication of a conventional time display.

6. A timepiece according to claim 4, wherein the indication 1 of the first display system is arranged on the timepiece between the 10 o'clock and 11 o'clock indications of a conventional time display.

7. A timepiece according to claim 4, wherein the indication 100 of the first display system is arranged between the 9 o'clock and 10 o'clock indications of a conventional time display.

8. A timepiece according to claim 1, comprising registers for storing decimal numbers formed by the combination of the order and the values respectively of the first and second display means.

9. A timepiece according to claim 8, comprising control means for adding the decimal numbers of said registers, and for obtaining the decimal number to be processed.

10. A timepiece according to claim 1, wherein the decimal number to be treated is a number of days.

11. A timepiece according to claim 1, wherein the hand of the first display system is the hour hand, while the hand of the second display system is the minute hand.

12. A timepiece according to claim 2, wherein the first display system comprises decimal multiples which define the order of said digits and which are marked between the 9 o'clock and 12 o'clock positions of said timepiece, and the second display system comprises indications 0 to 9 marked in the same place as the 12 o'clock to 9 o'clock indication of a conventional time display.

* * * * *